United States Patent [19]

Schneider

[11] 4,114,791

[45] Sep. 19, 1978

[54] FEEDING MECHANISM

[76] Inventor: Georg Schneider, Ludwigkai 27, Wuerzburg, Fed. Rep. of Germany, D-8700

[21] Appl. No.: 826,215

[22] Filed: Aug. 19, 1977

[30] Foreign Application Priority Data

Aug. 19, 1976 [DE] Fed. Rep. of Germany ..... 2637248

[51] Int. Cl.[2] ..... B65H 17/42

[52] U.S. Cl. ..... 226/91; 226/114; 226/150

[58] Field of Search ..... 226/113, 114, 91, 92, 226/118, 119, 147, 149, 150

[56] References Cited

U.S. PATENT DOCUMENTS

| | | | |
|---|---|---|---|
| 1,941,597 | 1/1934 | Cavagnaro | 226/114 |
| 3,414,179 | 12/1968 | Huck | 226/113 |
| 3,942,190 | 3/1976 | Detwiler | 226/113 X |

OTHER PUBLICATIONS

IBM Technical Disclosure Bulletin, "Automatic Tape Threading", R. B. Johnson et al., vol. 9, No. 8, p. 968, Jan. 1967.

*Primary Examiner*—Richard A. Schacher

*Attorney, Agent, or Firm*—Jones, Tullar & Cooper

[57] ABSTRACT

A feeding mechanism for the continuous feeding of printed carrier material such as printed packing material from an intermittent printer to a continuous storage reel or the like is disclosed. The printed material is fed between spaced alternating fixed and movable guide rollers. The movable rollers are spring biased and can be raised to a threading position above the fixed rollers. A backstop positioned between the printer and the feeding mechanism prevents return of the printed material from the feeding mechanism to the printer.

4 Claims, 8 Drawing Figures

FEEDING MECHANISM

FIELD OF THE INVENTION

The invention pertains to a device for the continuous feeding of printed carrier material stemming from an intermittently operating printer to a continuously unraveling processing and/or storage mechanism.

SUMMARY OF THE INVENTION

Feeding devices for band-shaped, printed packing material are already known. Such a feeding device can be connected with a continuously printing printer. It consists basically, of three pivoted foil paper guide rollers. These guide rollers are arranged in such a manner that their respective connecting lines passing through their centers of rotation constitute a triangle. Two of the guide pulleys are rigidly connected to the housing. The third is located at some distance from, and in between these two pulleys. It is subjected to either spring tension or is weighted. The printed, band-shaped, packing material emerging from a printing machine is threaded around these three guide rollers. A backstop, located between the feeding device and the discontinuously or intermittently printing machine, prevents a return of the printed-over foil paper.

The present invention addresses the problem of creating a device which allows a small, band-shaped, printed-over printing carrier coming intermittently or discontinuously from a printing machine to be fed into a packing machine that draws off or rolls up in a continuous operation. It is essential that the printing carrier can be quickly and easily threaded or mounted.

The advantage derived from the invention consists, in the first place, in the creation of a feeding device that requires little space and yet, still provides a large storage volume. Despite the small dimensions of the feeding device it is possible, for example, to mount a foil quickly and easily - even manually - onto the feeding mechanism.

BRIEF DESCRIPTION OF THE DRAWINGS

While the novel features of the feeding mechanism in accordance with the present invention are set forth with particularity in the appended claims, a full and complete understanding of the present invention may be had by referring to the description of a preferred embodiment as set forth hereinafter and as set forth in the accompanying drawings in which:

DESCRIPTION OF THE PREFERRED EMBODIMENT

Figure 1:
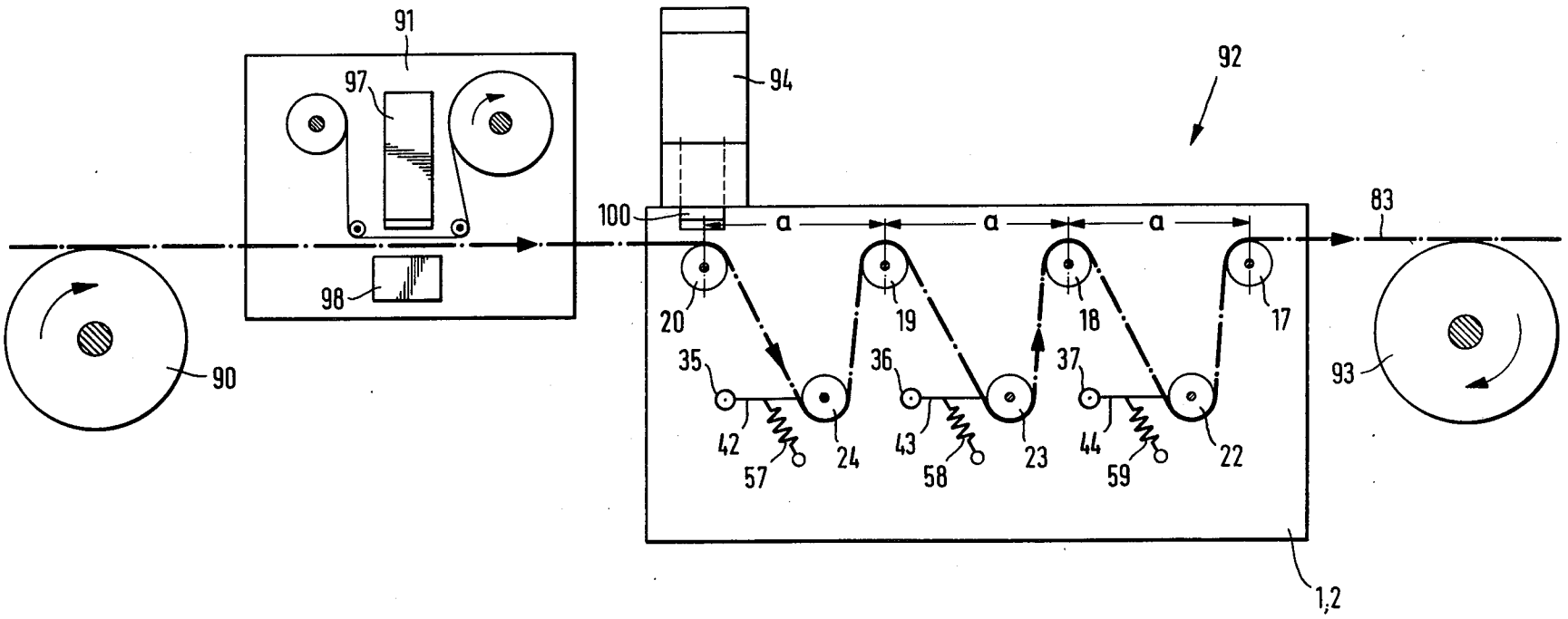
FIG. 1 is a schematic side elevation view of a preferred embodiment of a feeding mechanism in accordance with the present invention.
Figure 2:
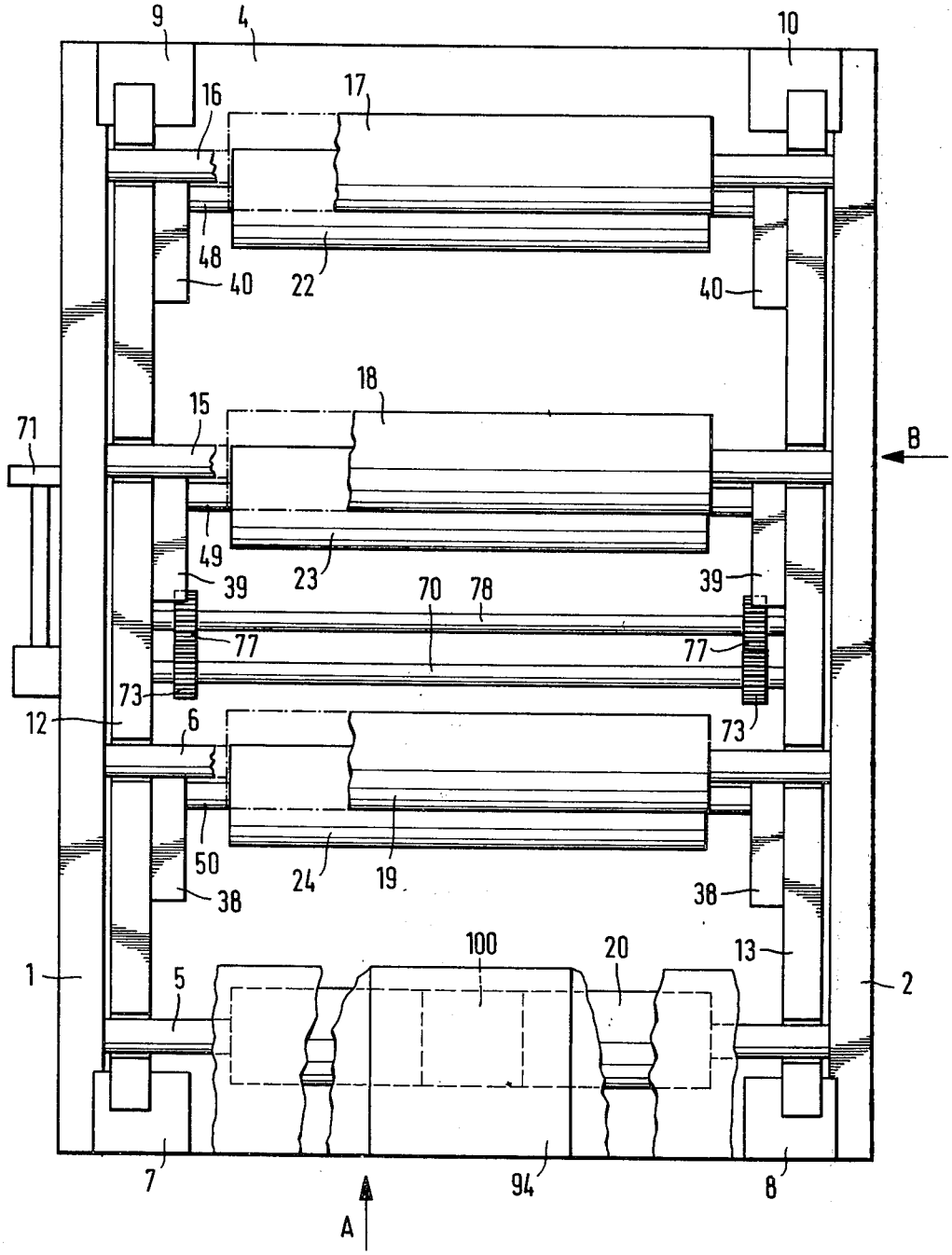
FIG. 2 is a top plan view of the feeding mechanism of the present invention.
Figure 3:
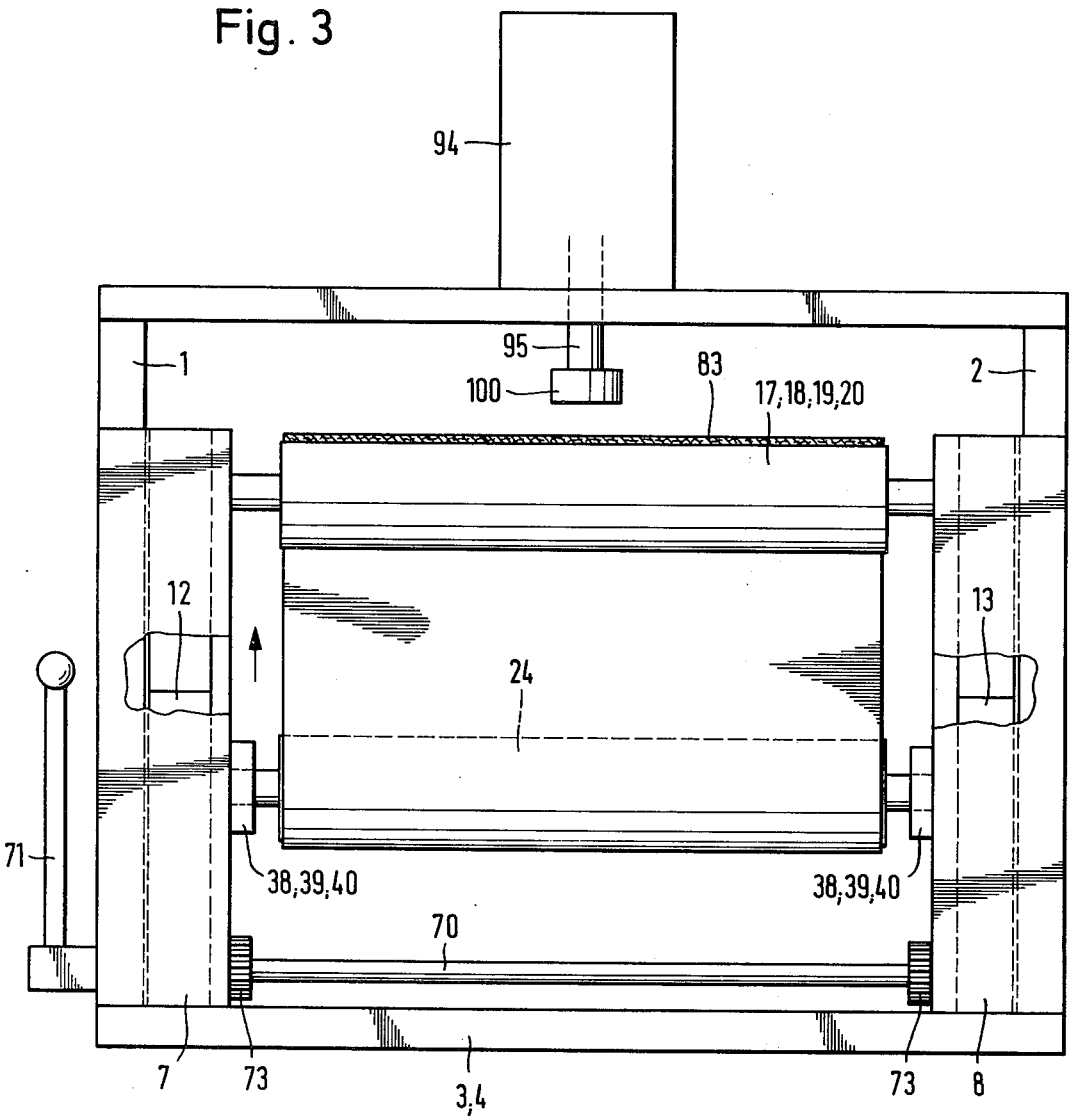
FIG. 3 is an end elevation view of the feeding mechanism taken in the direction indicated by arrow A in FIG. 2.
Figure 4:
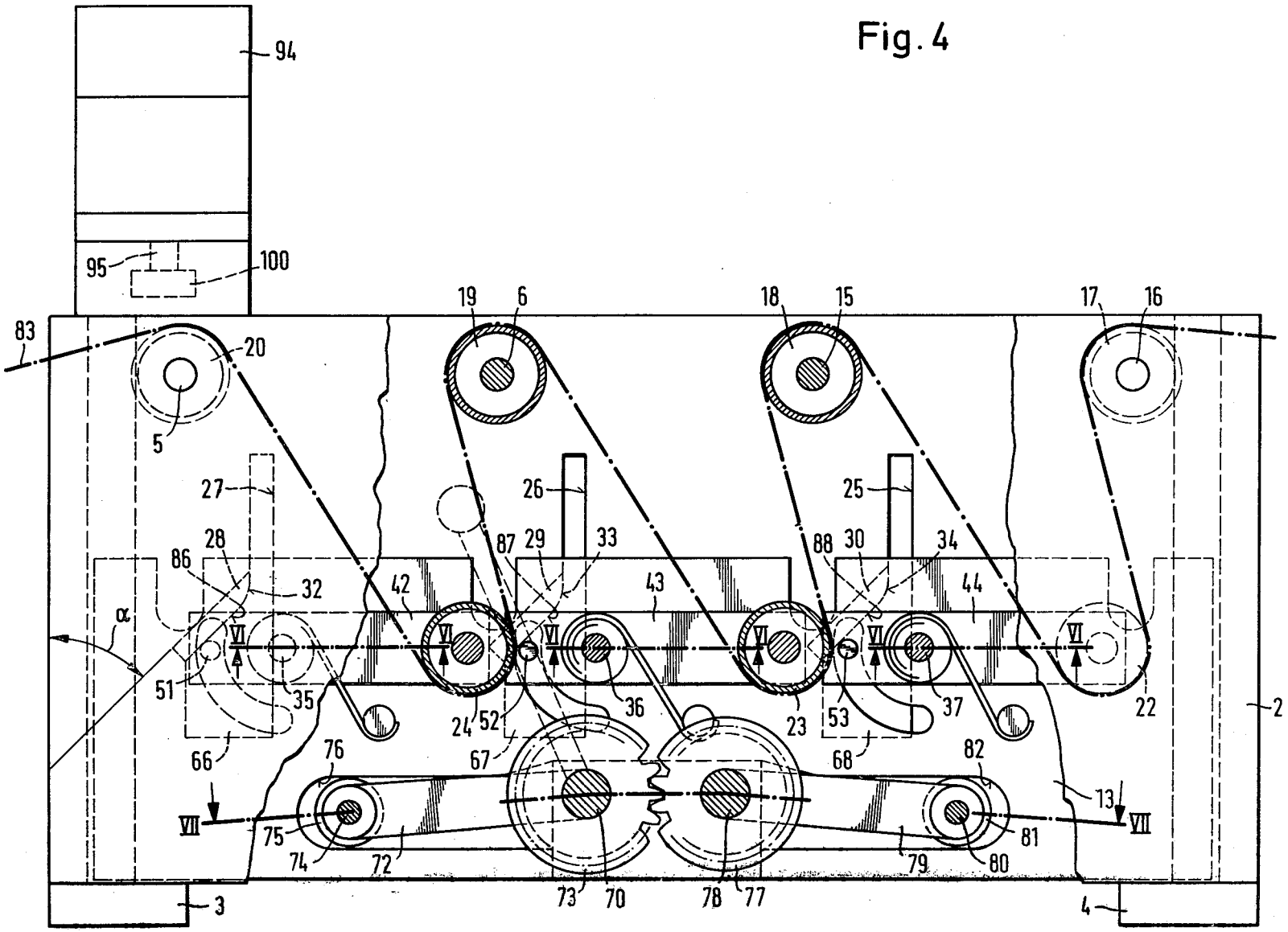
FIG. 4 is a side elevation view of the feeding mechanism taken in the direction indicated by arrow B in FIG. 2 and showing the mechanism in an operating mode.

Turning now to FIG. 1, there may be seen generally at 92 a preferred embodiment of a feeding mechanism in accordance with the present invention. As shown in FIG. 2, a pair of side panels 1, 2 which are identical mirror-images are bolted to the connecting pieces 3, 4 shown most clearly in FIGS. 3–5. These assure that the side panels 1, 2 are held together. Four guide pieces 7, 8, 9, 10 are bolted in pairs to the inside of the side panel 1 or 2. The guide pieces 7 and 9 constitute a guideway for the side panel 12, while the guide pieces 8 and 10 provide a guideway for the side panel 13 of the carriage 14. Inside these guideways, the carriage 14 can be moved up and down. Bars are form locked to the side panels 12 and 13. These provide the carriage with a certain rigidity. The spindles 16, 15, 6, 5 are paired with the guide cylinders 17, 18, 19, 20 which are spaced at a distancea, as may be seen in FIGS. 4 and 1, respectively. The cylinders, which pivot around their longitudinal axes, are mounted, non-torsionally, on the side panels 1 and 2.

Figure 8:
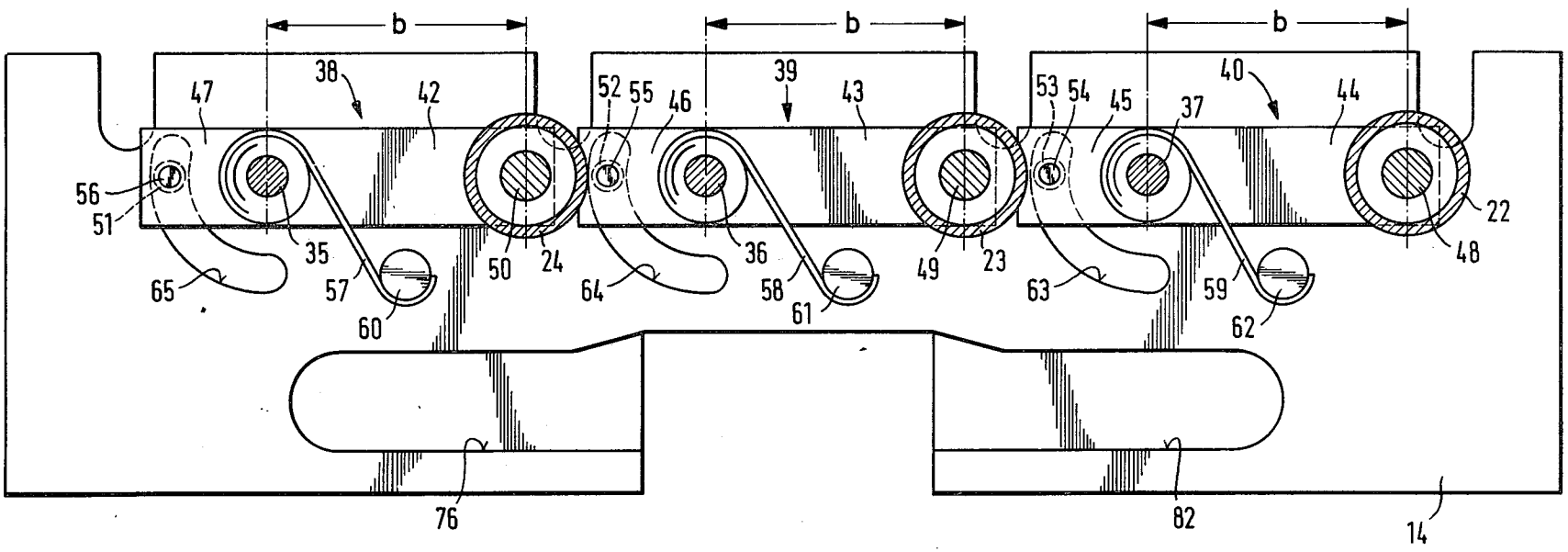
FIG. 8 is a side view of side panel 12 of carriage 14 of the feeding mechanism of the present invention, as viewed from inside the mechanism.

For driving the rotatable cylinders 22, 23, 24, which are acted on by springs 57, 58, and 59 the guide grooves 25, 26, 27 have been milled into the side panels 1 and 2. The drawing depicts the side panel 12 of the carriage 14 in all details. For reasons of simplification, the side panel 13 of carriage 14 has not been shown as it is mirror-image identical with side panel 12. Inside each of the guide grooves 25, 26, 27 of the side panels 1 and 2 ar obliquely mounted one fiber glass piece 30, 29, 28, each. These are inclined at an angle ($\alpha$) to the guide pieces 7 and 9, respectively. The upper part of the fiber glass pieces 28, 29, 30 are provided with a curved portion 32, 33, 34, each having a radius ($r$). The spindles 35, 36, 37 are pivotably mounted along the side panels 12 and 13 of the carriage 14. At each end of the spindles 35, 36, 37 is pinned a double-armed lever 38, 39, 40 so that a double armed lever rests on the inner surface of each of the side panels 12 and 13, respectively. At the ends of the longer lever arms 42, 43, 44 of the double armed levers 38, 39, 40 are mounted the ends of the spindles 48, 49, 50. These are mounted rigidly at a distance ($b$) from the center of rotation of the lever arms 38, 39, 40 of the spindles 35, 36, 37 all as may be seen in FIG. 8. The spindles 50, 49, 48 constitute the rotation axes for the lower row of cylinders 24, 23, 22. The pins 54, 55, 56 are screwed into the shorter lever arms 45, 46, 47 of the double armed levers 38, 39, 40. At their ends are mounted respectively the pulleys or rollers 51, 52, 53. The ends of the spiral springs 57, 58, 59 are, on the one hand, form locked to their paired spindles 35, 36, 37, while the other ends are linked into the pins 60, 61, 62 attached to the side panel 12, respectively 13. This makes it possible for the lower cylinders 22, 23, 24 to be spring-loaded. That is, they exert a force on a threaded, band-shaped material conveyor.

In order to make possible the rotation of the double-armed levers about their spindles 35, 36, 37 the recesses 63, 64, 65 have been milled into the side panels 12, 13. The pins 56, 55, 54 extend through these recesses by means of their tread rollers 51, 52, 53. The tread rollers 51, 52, 53 reach into their paired guide grooves 27, 26, 25 of the side panel 1 and 2, respectively.

Figure 7:
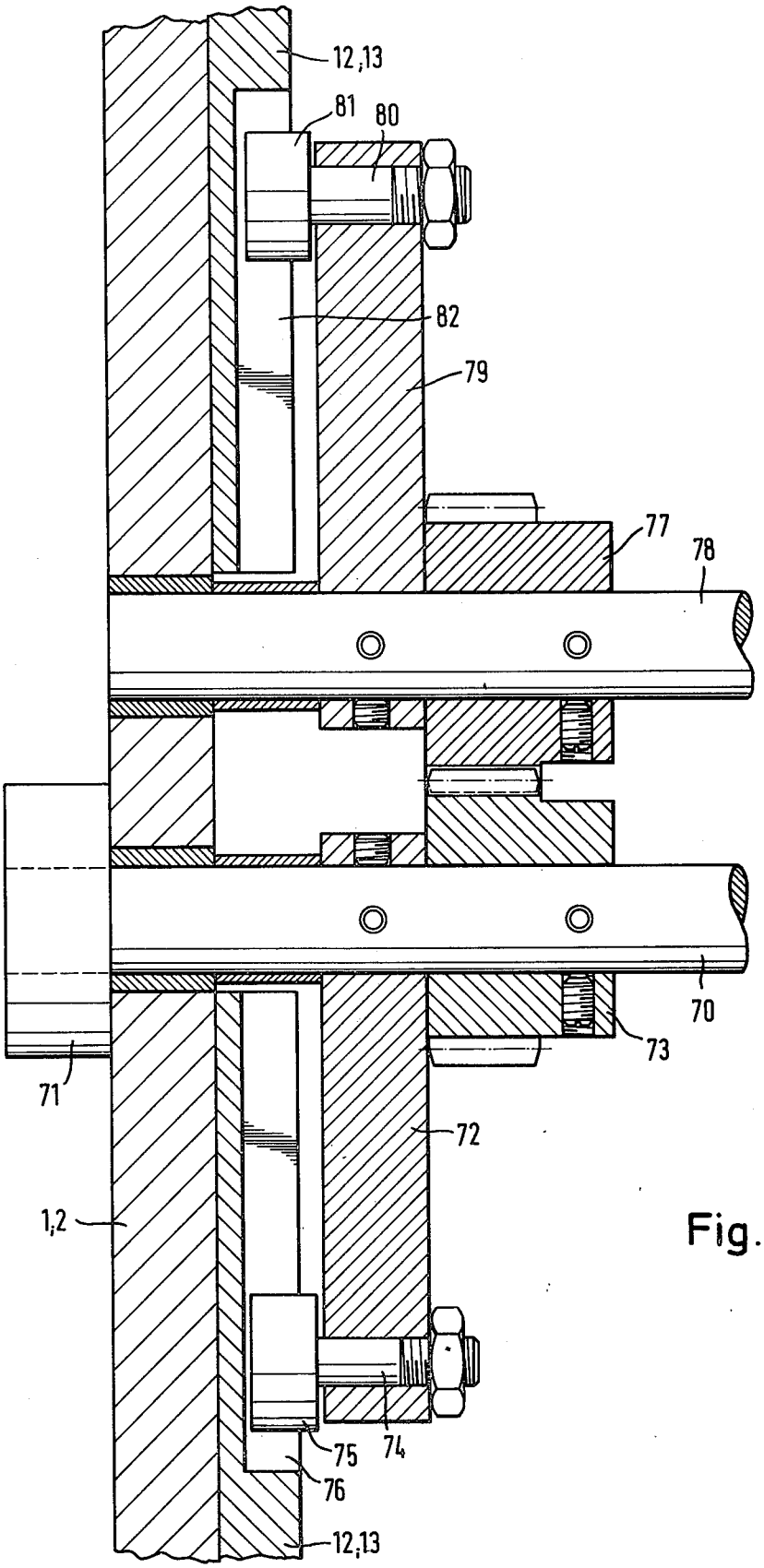
FIG. 7 is a partial view, partly in section, taken along line VII-VII in FIG. 4.

For the purpose of providing the up and down movement for the carriage 14, an operating mechanism is provided. It is designed as follows: a pivotable shaft 70 is mounted on the side panels 1 and 2. Along its free end, the shaft 70 is form locked to the hand lever 71. Between the two side panels 1 and 2, the shaft 70 is connected with a single armed lever 72 and a gear 73 as may be seen in FIG. 7. A pin 74 is provided with a roller 75 and is connected to the free end of the lever arm 72. This roller 75 is movably guided in the groove 76 which is pounded into the side panels 12 and 13. The gear 73 is engaged with the gear 77, which, in turn, is connected with the shaft 78. This shaft 78, is pivotably mounted along the side panels 1, 2. In addition, a single armed lever 79 is pinned to this shaft 78. This lever 79, carries along its free end the pin 80 on which a roller 81 is rotatably mounted. The tread roller 81 runs back and forth inside a slot 82 which is provided in the side panel 12, 13.

When the shaft 70 is rotated, the rotation movement is transmitted to shaft 78 by way of the gears 73, 77. The rotation of the shafts 70, 78 results in raising or lowering the lever arms 72, 79 depending on the direction of rotation of shaft 70. Since the rollers 75, 81, which are connected with the lever arms 72, 79, run inside the grooves 76, 82, the lifting of the lever arms 72, 79 is tantamount to lifting the side panels 12, 13 and thus, the carriage 14.

Figure 5:
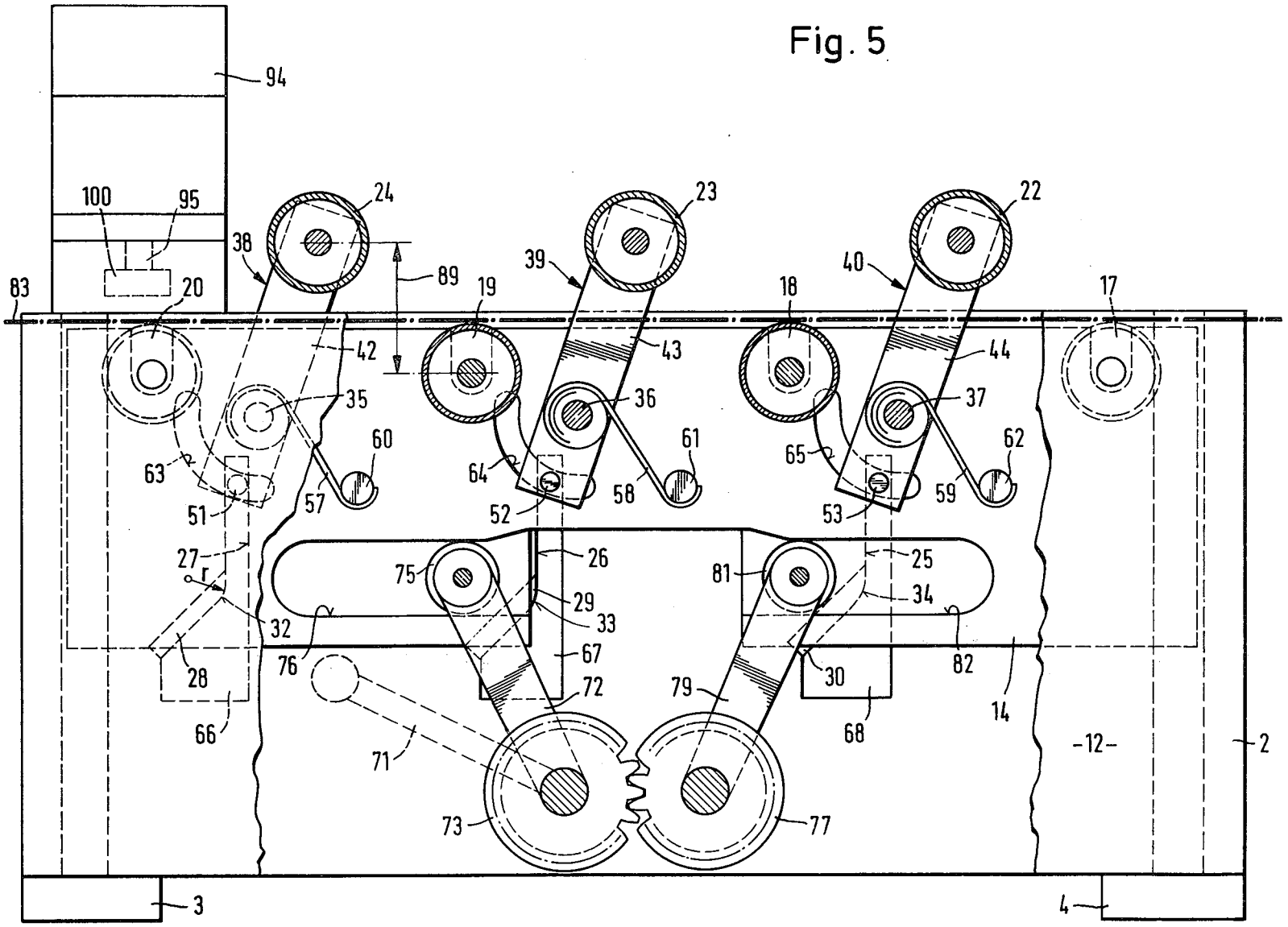
FIG. 5 is similar to FIG. 4 and shows the feeding mechanism in a threading mode.
Figure 6:
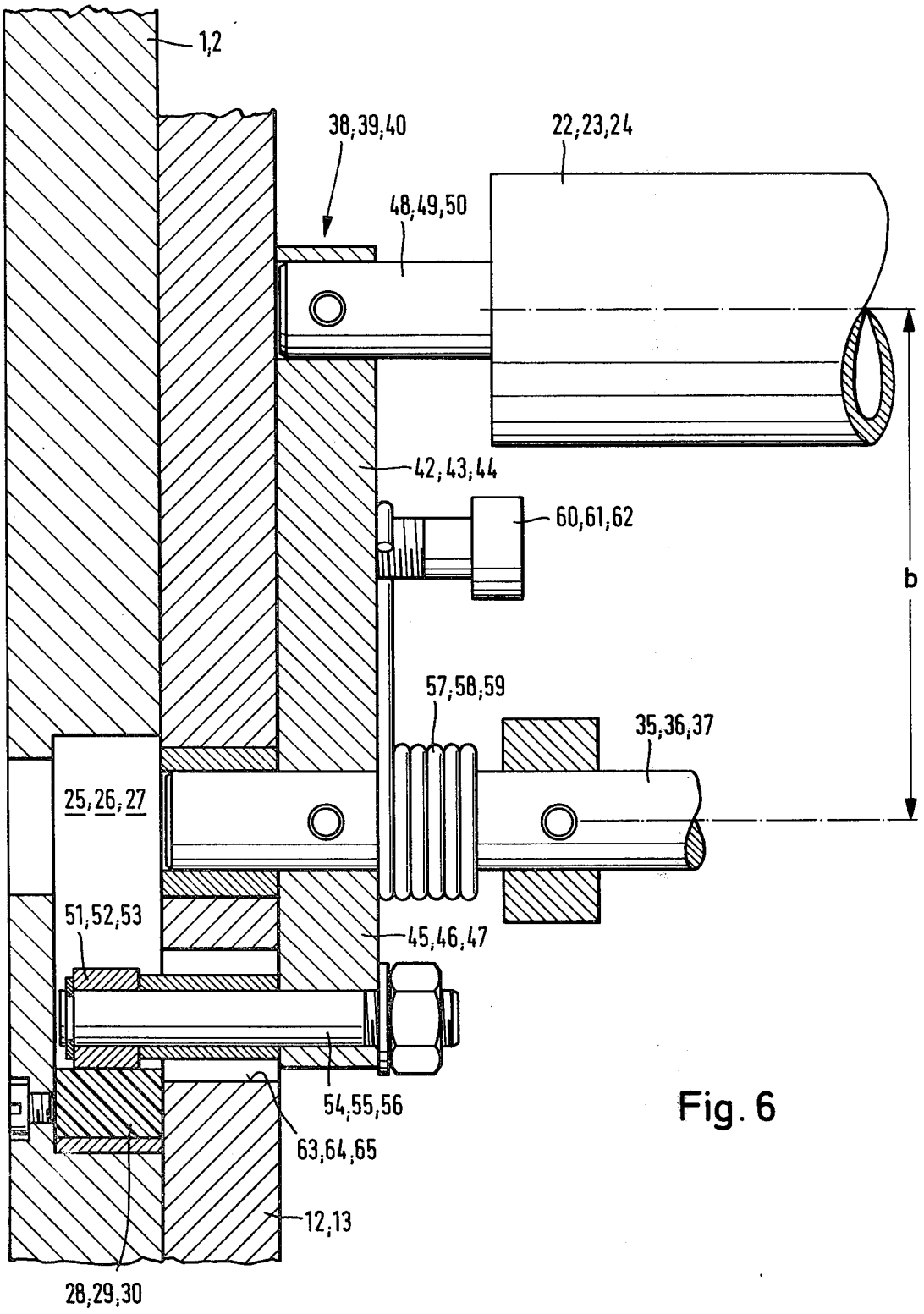
FIG. 6 is a partial view, partly in section, taken along line VI-VI in FIG. 4.

In a state of rest, that is, when the band-shaped material 83 has not been threaded or mounted, the tread rollers 51, 52, 53 rest against the fiber glass pieces 28, 29, 30 located in the paired grooved free spaces 66, 67, 68 of the side panels 1 or 2. If the carriage 14 is now moved in the direction of "threading of bandshaped material" mode, as shown in FIG. 5, then the rollers 51, 52, 53 move along their respectively paired running surfaces 86, 87, 88 of the fiber glass pieces 28, 29, 30, respectively, as may be seen in FIG. 4. The motion of the runners 51, 52, 53 causes the displacement of arms 42, 43, 44 from a horizontal to a vertical position with the spindles 35, 36, 37 providing the axes of rotation. This causes the movable cylinders 22, 23, 24 of the bottom cylinder row to pass through the interval of two adjacent, rigidly mounted cylinders 17, 18, 19, 20. For example, cylinder 24 passes through the gap between cylinders 19 and 20; cylinder 23 passes between cylinders 18 and 19; and cylinder 22 between 18 and 17. They come to rest at a distance 89 from the upper row of the cylinders 17 through 20, as may be seen in FIG. 5. The lever arms 42, 43, 44, are dimensioned in such a way that in the vertical endposition for "threading of the band-shaped material" the cylinders 22, 23, 24 extend beyond the cylinders 17, 18, 19, 20 of the upper cylinder row, by the distance or interval 89. This interval 89 is selected so as to allow an easy, even manual, threading of the band-shaped material 83 or automatic threading by means of a suitable device.

Once the band shaped material 83 has been introduced between the cylinder rows 17, 18, 19, 20 on the one hand, and the cylinders 22, 23, 24, on the other hand, then the carriage 14 is brought into its operating position via suitable raising and lowering devices. In this position the cylinders 22, 23, 24 are moved from their place above the cylinders 17, 18, 19 to below these. Once a band shaped material 83 has been threaded, then the position of the movable, spring loaded cylinders 22, 23, 24 depends on the preselected tension of the band shaped material 83. Depending on the selected pulling length of the band shaped material 83, the rollers 51, 52, 53 will lift off, more or less, from the running surfaces 86, 87, 88 of the fiber glass pieces 28, 29, 30.

FIG. 1 depicts schematically the interaction of the material storage feeder 92 with the pressure device 91. A band shaped material 83 that is to be imprinted is drawn from a stock delivery spool 90 by means of a pressure mechanism 91 and the material storage or feeding apparatus 92, via a driven spool 93 or a processing device such as a packing machine. The material 83 envelops the cylinders 17, 18, 19, 20, 22, 23, 24. Shortly before the printing begins, a pneumatic cylinder 94 is activated and presses the brake shoe 100, which is attached to a piston rod 95, against a pivotable cylinder 20. That is, the first panel connected cylinder. This cylinder follows the motion of the printing carrier and of the printing device 91. This causes the cylinder 20 to become arrested and fixed and as a result the length of material 83 between the cylinder 20 and the storage spool 90 will be at rest. During this halting interval, the material length 83 can be printed, for example, by means of a pressure stamp 97 or the printing block 98. During this printing process, a part of the band shaped material 83 is drawn off the storage or feeding mechanism 92, since the spool 93 continuous to rotate or the processing mechansim continuously withdraws material. That means that the spring loaded, compensating, cylinders 22, 23, 24 move towards the rigidly mounted cylinders 17, 18, 19, 20. Once the printing process is completed, the pneumatic cylinder 94 becomes inactive. That is, the cylinder 20 with the print carrier 83 is released and the band shaped material 83 can again be pulled from the storage spool 90 so that the feeder device 92 can advance. The spring loaded cylinders 22, 23, 24 rotate around their centers of rotation — spindles 35, 36, 37 — and away from the rigid cylinders 17, 18, 19, 20.

Thus it may be seen that a full and complete description of a preferred embodiment of a feeding mechanism in accordance with the present invention has been set forth hereinabove. It will be obvious to one of skill in the art that a number of changes in, for example, the types of bearings used, the number of fixed and movable cylinders; the types of materials handleable by the device and the like can be made without departing from the true spirit and scope of the invention and accordingly the invention is to be limited only by the appended claims.

I claim:

1. A feeding mechanism for continuously feeding a printed carrier material from an intermittently operating printer to a continuously operating processing or storage mechanism, said feeding mechanism comprising:

an upper horizontal row of guide cylinders secured at their ends to spaced side panels;

a movable carriage carried by guide pieces secured to said side panels;

a lower row of rotatable cylinders each said rotatable cylinder secured to a first end of a spring loaded arm, each of said arms pivotably secured at a point intermediate its ends to spaced side portions of said carriage, second ends of said arms being guided in guide slots in said side panels; and means to raise said carriage to position said rotatable cylinders above said guide cylinders during threading of said carrier material through said feeding mechanism and to lower said carriage to position said rotatable cylinders below said guide cylinders during feeding of said carrier material through said feeding mechanism.

2. The feeding mechanism of claim 1 further including a locking device for preventing the return of the carrier material from the feeding mechanism to the printer.

3. The feeding mechanism of claim 1 further wherein each of said spring biased arms is biased by a spiral spring secured at a first end to said arm and at a second end to said carriage.

4. The feeding mechanism of claim 1 wherein said means to raise and lower said carriage includes first and second lever arms, each of said lever arms having a first end carrying a roller slidable in a groove in said side portion of said carriage, each of said lever arms having a second end secured to a rotatable shaft, one of said shafts passing through said side panels, each of said shafts further carrying intermeshing gears whereby rotation of said shafts causes said carriage to raise and lower.

* * * * *